United States Patent [19]

McIntyre

[11] Patent Number: 4,653,750

[45] Date of Patent: Mar. 31, 1987

[54] THORACIC RESTRAINT FOR EXERCISE APPARATUS

[75] Inventor: Donald R. McIntyre, Chapel Hill, N.C.

[73] Assignee: Isotechnologies, Inc., Hillsborough, N.C.

[21] Appl. No.: 820,718

[22] Filed: Jan. 17, 1986

[51] Int. Cl.[4] ..... A63B 21/00

[52] U.S. Cl. ..... 272/134; 272/143; 128/78; 128/134

[58] Field of Search ..... 128/78, 134, 33, 133; 272/134, 118, 143; 297/216, 416, 411, 353

[56] References Cited

U.S. PATENT DOCUMENTS

| | | | |
|---|---|---|---|
| 30,601 | 11/1860 | Wright | 128/78 |
| 129,202 | 7/1872 | Zachcs | 128/78 |
| 2,828,735 | 4/1958 | Thompson | 128/75 |
| 3,359,976 | 12/1967 | Laval, Jr. | 128/75 |
| 3,889,664 | 6/1975 | Heuser | 128/78 |
| 3,926,182 | 12/1975 | Stabholz | 128/78 |
| 4,434,793 | 3/1984 | Willits | 128/134 |

*Primary Examiner*—Richard J. Apley
*Assistant Examiner*—James Prizant
*Attorney, Agent, or Firm*—Richard E. Jenkins

[57] ABSTRACT

An improved thoracic restraint device is provided for use in association with a low back exercise machine adapted for evaluating low back exercise movement against a resistance, particularly rotational movement of the lower back. The restraint comprises a back support having a pair of horizontally extending arms and a pair of flexible restraint straps adapted to be secured across the thorax of the user to the arms so as to secure the thorax of the user against the back support. In order to further limit rotational movement of the thorax during low back exercise, an adjustable back stabilizer is provided beneath the back support and adapted to restrainingly engage the lower thoracic area of the back so as to minimize rotation of the thoracic vertabrae during low back exercise.

12 Claims, 3 Drawing Figures

THORACIC RESTRAINT FOR EXERCISE APPARATUS

DESCRIPTION

1. Technical Field

This invention relates to an improved thoracic restraint device intended for use on an exercise machine which would most suitably be a low back exercise machine adapted for allowing the user to move against a resistance in order to evaluate back movement. More specifically, the thoracic restraint device of the present invention is intended for use with a low back exercise apparatus of the type adapted to allow three-dimensional back movement by the user including rotation, flexion and extension, and lateral flexion type movements which may most suitably be analyzed by a computer associated with the low back exercise apparatus. The improved thoracic restraint provides an auxiliary back stabilizer bar which enables the thoracic restraint to better control thoracic rotation or twisting during exercise and thereby isolate low back movement for evaluation.

2. Background Art

The applicant has previously utilized a thoracic restraint device on a low back exercise apparatus which has been found to suffer certain deficiencies which are believed to have been overcome by the restraint device of the instant invention. More particularly, applicant's prior thoracic restraint device generally comprises an upstanding back support having a pair of rigid, spaced-apart arms extending outwardly therefrom and a pair of spaced-apart flexible restraint straps also extending from the back support for securement to the aforementioned arms so as to secure the thorax of the user. This type of thoracic restraint has been found to allow for a significant amount of upper back rotation which is contributed by thoracic vertabrae which tend to twist during exercise, particularly rotation-type exercises. It has therefore been found desirable to better stabilize the thoracic vertabrae against twisting type movement in order to better isolate and evaluate low back movement or, more specifically, movement of the lumbar portion of the back which is positioned below the thoracic portion and above the sacral portion of the back. The lumbar vertabrae comprise what is generally referred as the low back portion of the spinal column which tends to develop deficiencies and require evaluation in a very significant portion of the general population.

DISCLOSURE OF THE INVENTION

The present invention provides for an improved thoracic restraint for use on a low back exercise apparatus, particularly of the type intended for evaluation of low back injury or disability. The improved thoracic restraint device of the present invention is particularly well suited for use in an exercise apparatus which is adapted for three-dimensional low back movement including rotation movement, lateral flexion movement, and flexion and extension movement of the back. Although other thoracic restraints are known to the applicant, it is not believed that any known restraint serves to so effectively control twisting of the thoracic vertabrae during exercise, particularly rotation exercises, in order to isolate and evaluate low back or lumbar vertabrae movement. This is primarily accomplished by the provision of an adjustable stabilizer bar for restraining engagement of the back adjacent the lower thoracic vertabrae and below the back plate of the primary thoracic restraint.

In accordance with the present invention, an improved thoracic restraint device is provided for use with a low back exercise apparatus, particularly an exercise apparatus of the type electrically connected to an associated computer for performance evaluation, and comprises an upstanding back support secured by means of a carriage to the associated exercise apparatus, a pair of side arms extending outwardly from the back support, and an associated pair of flexible restraint straps extending from the back support and adapted for engagement to the support arms. An adjustable back stabilizer is also provided beneath the back support and cooperatively associated with the back support so as to be vertically and horizontally adjustable in order to supportingly engage the lower portion of the back adjacent the lower thoracic vertabrae in order to prevent rotation of the thoracic vertabrae during rotation type movements and thereby isolate and evaluate low back or lumbar vertabrae movement. The back stabilizer is tightly secured to the user by a restraint belt which extends around the lower thorax of the user and is secured at each end of the back stabilizer. The vertical and horizontal adjustability of the back stabilizer allows the improved thoracic restraint device to accommodate users of varying sizes and shapes while still inhibiting significant thoracic twisting during back exercise by the user of an exercise apparatus associated with the thoracic restraint device of the present invention.

It is important to appreciate that the improved thoracic restraint of the present invention utilizing the adjustable back stabilizer will facilitate better evaluation of spinal motion while the exerciser is performing a variety of exercises. However, it is particularly significant during rotation movements that the thoracic rotation be minimized if evaluation of the low back is desired in view of the fact that the majority of spinal motion by an unrestricted user will naturally occur in the upper back among the thoracic and cervical vertabrae. In order to better evaluate the low back lumbar vertabrae, the aforementioned motion by the thoracic and cervical vertabrae should be restricted to the greatest extent possible. This is believed to be accomplished by the improved thoracic restraint device of the present invention.

It is therefore the object of this invention to provide an improved thoracic restraint for use with an associated exercise apparatus in order to minimize movement of the upper back during exercise.

More specifically, it is an object of the invention to restrict normal thoracic and cervical vertabrae rotation during back evaluation exercises in order to isolate and evaluate low back or lumbar vertabrae function.

DESCRIPTION OF THE DRAWINGS

Some of the objects of the invention having been stated, other objects will become evident as the description proceeds, when taken in connection with the accompanying drawings, in which.

BEST MODE FOR CARRYING OUT THE INVENTION

Figure 1:
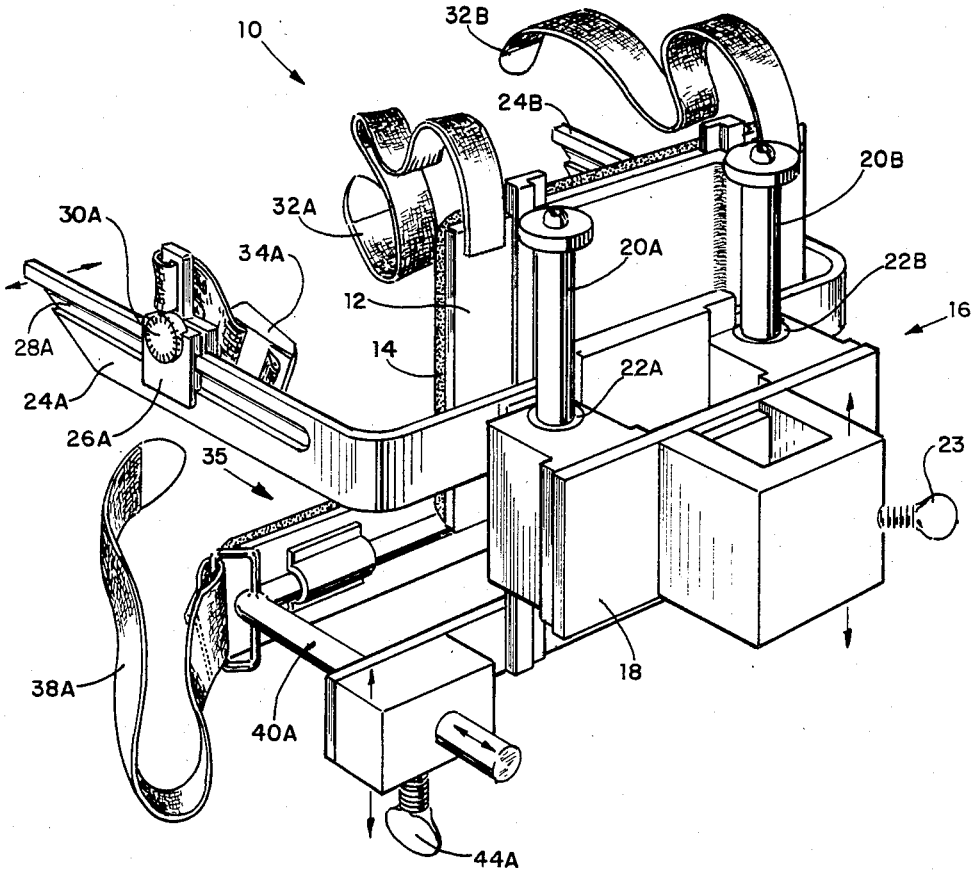
FIG. 1 is a rear perspective view of the thoracic restraint of the instant invention.
Figure 1A:
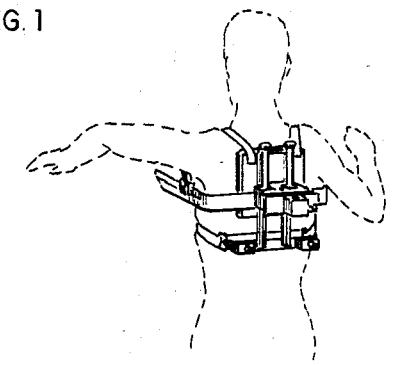
FIG. 1A is a reduced size perspective of the thoracic restraint of the instant invention with an upstanding user depicted in phantom lines secured thereto.
Figure 2:
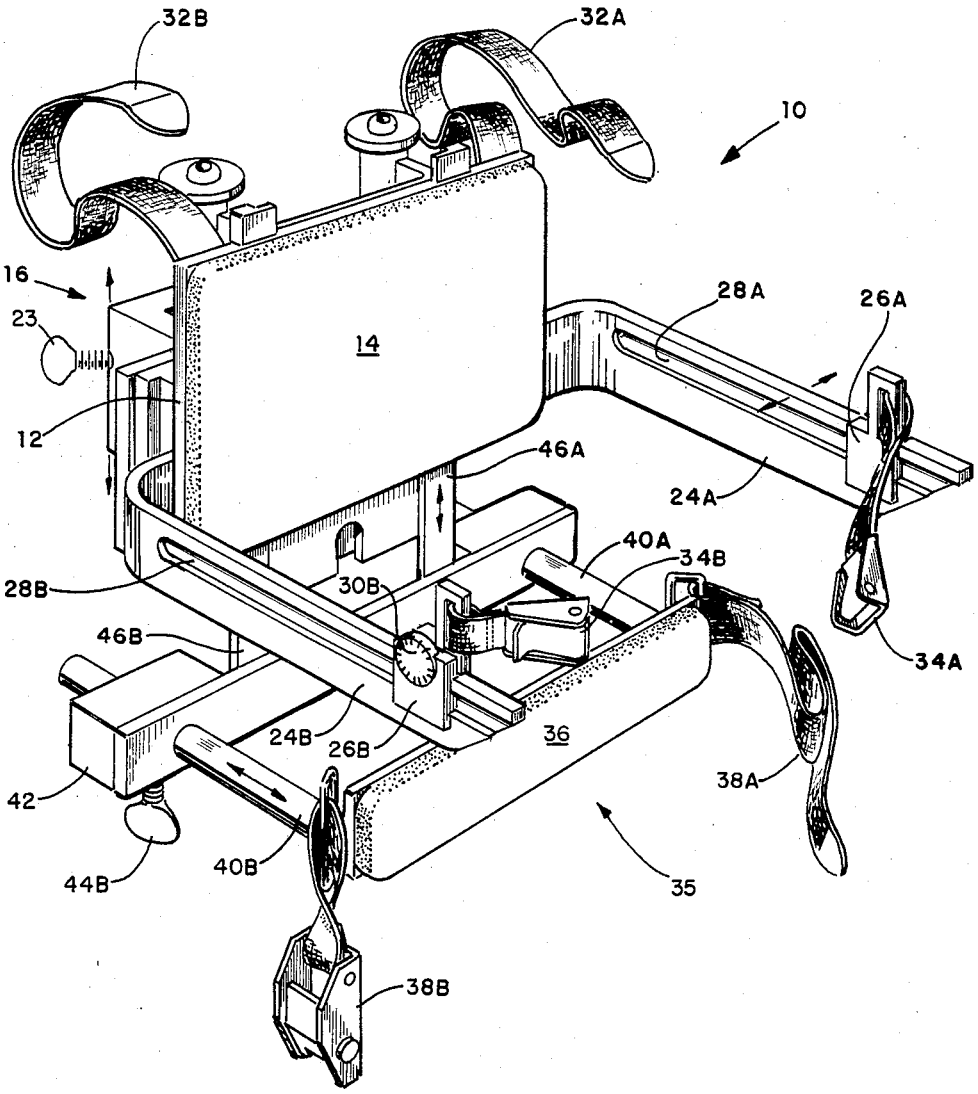
FIG. 2 is a front perspective view of the thoracic restraint of the instant invention.

Referring now more specifically to the drawings, a preferred embodiment of a thoracic restraint according to the present invention is shown in FIGS. 1 and 2 and generally designated 10. The thoracic restraint device comprises a back support 12 formed of a rigid material such as plastic or steel and having a resilient pad 14 affixed to the user's side thereof. Back plate 12 is secured to carriage 16 which comprises a housing 18 fixedly secured to the exercise machine by set screw 23 and adapted to allow thoracic restraint 10 to move vertically relative thereto by means of rails 20A, 20B which are fixedly secured to back support 12 and vertically travel through housing 18 on linear bearings 22A, 22B, respectively. This free vertical movement is intended to accommodate spinal elongation during exercise. Carriage 16 may be vertically adjusted to accommodate users having varying trunk lengths by disengaging set screw 23, vertically adjusting housing 18 on the exercise apparatus and then fixedly engaging screw 23 again.

Thoracic restraint 10 further includes a pair of arms 24A, 24B which extend outwardly from back support 12. Arms 24A, 24B extend behind back support 12 and are in sliding engagement so that the arms may be laterally adjusted as necessary to accommodate the thorax of a user of the associated exercise machine. An adjustable clamp 26A, 26B having an associated buckle 34A, 34B is provided on each arm 24A, 24B and adapted so as to matingly engage a slot 28A, 28B defined within arm 24A, 24B and be slidably movable along the slot. Thumb screws 30A, 30B are provided to secure respective clamps 26A, 26B at a desired location on arms 24A, 24B. A pair of restraint belts 32A, 32B are each secured at one end thereof to back support 12 and are adapted to be engagingly secured by buckles 34A, 34B, respectively, associated with clamps 26A, 26B. In this fashion, restraint belts 32A, 32B are extended over the shoulders and downwardly across the thorax of the user of an exercise machine associated with thoracic restraint 10 and secured to respective buckles 34A, 34B in order to restrain the thorax of the user against back support 12.

In order to provide additional stability to the upper back during exercise in a low back exercise apparatus, a rigid back stabilizer 35 is provided so as to engage the back below back support 12 and adjacent the lower thoracic vertabrae of the user. Back stabilizer 35 most suitably includes a resilient pad 36 on the body contact side thereof and further includes a lower thorax restraint belt 38A, 38B secured adjacent each side of back stabilizer 35. Lower thorax restraint belt 38A, 38B may be of conventional construction and includes belt portion 38A and buckle portion 38B. Back stabilizer 35 is adapted for both vertical and horizontal adjustment so as to best accommodate the lower thorax of a given user of a low back exercise apparatus utilizing thoracic restraint 10. Back stabilizer 35 is mounted on parallel rods 40A, 40B which are slidingly received by support frame 42. Set screws 44A, 44B are provided if it should be deemed necessary or desirable to secure back stabilizer 35 at a desired position against the back of the user by engaging rods 40A, 40B within support frame 42. Support frame 42 is secured to back support 12 by two vertical connecting members 46A, 46B which are slidably received between back support 12 and carriage assembly 16. In order to vertically adjust back stabilizer 35, support frame 42 is merely pushed up toward or pulled down from back support 12.

In operation, a user of a low back exercise machine is positioned in thoracic restraint device 10 by placing the user's back against resilient pad 14, lifting the user's arms upwardly and then pulling restraint belts 32A, 32B over the user's shoulders and downwardly across the thorax and into engagement with respective buckles 34A, 34B which are suitably positioned on arms 24A, 24B and fastened thereto by clamps 26A, 26B. If necessary, arms 24A, 24B are laterally adjusted to accommodate the user prior to fastening restraint belts 32A, 32B to buckles 34A, 34B. Next, support frame 42 is vertically adjusted so as to bring back stabilizer 35 into the appropriate vertical position adjacent the desired thoracic vertabrae portion of the user's back. Back stabilizer 35 is then adjusted inwardly so that resilient pad 36 comes into restraining contact with the back of the user. Set screws 44A, 44B may be used, if appropriate, to secure back stabilizer 35 in the desired position and restraint belt 38A, 38B is then secured around the lower thorax of the user. In this manner, a thoracic restraint is provided which is comfortable to the user and provides superior limitation of rotational movement of the thorax and thoracic vertabrae when the low back of the user is being exercised, particularly when a rotational exercise is being conducted which normally entails greater thoracic vertabrae spinal motion than is involved in either flexion and extension or lateral flexion low back exercises. Although effective for all low back exercises, it can be seen that the instant invention is particularly helpful in isolating and evaluating low back capability in rotational movement or exercise.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus.

What is claimed is:

1. A thoracic restraint device for use with a low back exercise apparatus of the type wherein the user is secured thereto in an upstanding or sitting position, said restraint comprising:

an upstanding back support;

a pair of spaced-apart arms each extending outwardly from an opposing side of said back support;

a pair of spaced-apart restraint straps secured adjacent the top of said back support;

fastening means cooperatively engaging each of said arms for securement of said restraint straps thereto so as to restrain the thorax of the user between said straps and said back support;

an adjustable back stabilizer positioned beneath said back support and cooperatively associated therewith for supportingly engaging the lower portion of the user's back adjacent the lower thoracic vertabrae;

a lower thorax restraint belt secured adjacent opposing sides of said back stabilizer; and means for coupling said thoracic restraint device to a low back exercise apparatus;

whereby twisting of the upper back of the user of the low back exercise apparatus is minimized during exercise so as to isolate low back movement.

2. A thoracic restraint according to claim 1 wherein said back support is secured to a carriage, said carriage being secured to the exercise apparatus and adapted for allowing vertical movement by said back support.

3. A thoracic restraint according to claim 1 wherein said back support comprises a resiliently padded body contact surface.

4. A thoracic restraint according to claim 1 wherein said spaced-apart arms are laterally adjustable.

5. A thoracic restraint according to claim 1 wherein each of said fastening means comprises a clamp adapted to slidingly engage a respective one of said arms, a thumb screw for securing said clamp at a desired location on said arm, and a buckle for securing a respective one of said restraint straps.

6. A thoracic restraint according to claim 1 wherein said back stabilizer comprises an elongate support adjustably mounted to a support frame by a plurality of rod members slidably received by said support frame so as to accommodate adjustment of said elongate support generally perpendicularly to the user's back, said support frame and cooperatively engaged elongate support also being adapted for vertical adjustment relative to said upstanding back support.

7. A thoracic restraint according to claim 6 wherein said elongate support comprises a resiliently padded body contact surface.

8. In combination with a thoracic restraint device for use with a low back exercise apparatus, said thoracic restraint having an upstanding back support secured to a carriage, a pair of arms each extending outwardly from opposing sides of said back support, and a pair of spaced-apart restraint straps extending from said back support and each adapted to engage a respective one of said arms, the improvement comprising a vertically adjustable back stabilizer cooperatively secured beneath said back support and adapted for supportingly engaging the lower portion of the user's back adjacent the lower thoracic vertabrae and including a lower thorax restraint belt secured adjacent opposing sides of said back stabilizer for securing the user against said back stabilizer and means for coupling said thoracic restraint device to a low back exercise apparatus.

9. The combination according to claim 8 wherein said back stabilizer comprises an elongate support adjustably mounted to a support frame by a plurality of rod members slidably received by said support frame so as to accommodate adjustment of said elongate support generally perpendicularly to the user's back, said support frame and cooperatively engaged elongate support being vertically adjustable relative to said upstanding back support.

10. The combination according to claim 9 wherein said support frame for said elongate support includes a pair of upwardly extending connecting members which are slidably received by the carriage secured to said upstanding back support so as to provide for vertical adjustment of said elongate support relative to said back support.

11. The combination according to claim 9 wherein said support frame includes a set screw associated with each of said plurality of rod members for lockingly engaging said rod members at a selected point along the length thereof.

12. The combination according to claim 9 wherein said elongate support comprises a resiliently padded body contact surface.

* * * * *